US008267184B2

(12) United States Patent
Kriesels

(10) Patent No.: US 8,267,184 B2
(45) Date of Patent: Sep. 18, 2012

(54) METHOD OF RADIALLY EXPANDING A TUBULAR ELEMENT

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 289 days.

(21) Appl. No.: 12/743,992

(22) PCT Filed: Nov. 20, 2008

(86) PCT No.: PCT/EP2008/065903

§ 371 (c)(1),
(2), (4) Date: May 20, 2010

(87) PCT Pub. No.: WO2009/065890

PCT Pub. Date: May 28, 2009

(65) Prior Publication Data

US 2010/0243275 A1 Sep. 30, 2010

(30) Foreign Application Priority Data

Nov. 22, 2007 (EP) ..... 07121302

(51) Int. Cl.
*E21B 19/00* (2006.01)

(52) U.S. Cl. ..... 166/384; 166/207

(58) Field of Classification Search ..... 166/380, 166/384, 207

See application file for complete search history.

(56) References Cited

U.S. PATENT DOCUMENTS

| | | | | |
|---|---|---|---|---|
| 4,602,974 | A | 7/1986 | Wood et al. | 156/287 |
| 5,501,337 | A | 3/1996 | Sowden | 206/528 |
| 6,109,828 | A * | 8/2000 | Keller | 405/146 |
| 6,446,670 | B1 * | 9/2002 | Woodward et al. | 138/98 |
| 7,946,349 | B2 * | 5/2011 | Kriesels | 166/384 |
| 8,056,641 | B2 * | 11/2011 | Kriesels et al. | 166/384 |
| 8,056,642 | B2 * | 11/2011 | Kriesels et al. | 166/384 |
| 8,141,647 | B2 * | 3/2012 | Kriesels et al. | 166/380 |

FOREIGN PATENT DOCUMENTS

| | | | |
|---|---|---|---|
| EP | 44706 | | 1/1982 |
| EP | 611914 | * | 1/1994 |
| WO | WO2005024178 | | 3/2005 |

* cited by examiner

*Primary Examiner* — William P Neuder

(57) ABSTRACT

A method of radially expanding a tubular element extending into a wellbore formed in an earth formation comprises inducing the wall of the tubular element to bend radially outward and in an axially reverse direction so as to form an expanded tubular section extending around a remaining tubular section of the tubular element, wherein the bending occurs in a bending zone of the tubular element. The bending zone is induced to move in an axial direction relative to the remaining tubular section to increase the length of the expanded tubular section. An annular space is formed between the expanded tubular section and the remaining tubular section, wherein the method further comprises arranging a seal element in the annular space to define an upper portion and a lower portion of the annular space, the upper and lower portions being sealed from each other by the seal element.

15 Claims, 6 Drawing Sheets

METHOD OF RADIALLY EXPANDING A TUBULAR ELEMENT

PRIORITY CLAIM

The present application claims priority to PCT Application PCT/EP2008/065903, filed 20 Nov. 2008, which in turn claims priority from European Application EP07121302.9, filed 22 Nov. 2007.

TECHNICAL FIELD OF THE INVENTION

The present invention relates to a method of radially expanding a tubular element in a wellbore.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a downhole location further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP 0044706 A2 discloses a method of radially expanding a flexible tube of woven material or cloth by eversion thereof in a wellbore, to separate drilling fluid pumped into the wellbore from slurry cuttings flowing towards the surface.

Although in some applications the known expansion techniques may show promising results, there is a need for an improved method of radially expanding a tubular element in a wellbore.

SUMMARY OF THE INVENTION

In accordance with the invention there is provided a method of radially expanding a tubular element extending into a wellbore formed in an earth formation, the method comprising

- inducing the wall of the tubular element to bend radially outward and in axially reverse direction so as to form an expanded tubular section extending around a remaining tubular section of the tubular element, wherein said bending occurs in a bending zone of the tubular element;
- increasing the length of the expanded tubular section by inducing the bending zone to move in axial direction relative to the remaining tubular section;

wherein an annular space is formed between the expanded tubular section and the remaining tubular section, and wherein the method further comprises

- arranging a seal element in the annular space to define an upper portion and a lower portion of the annular space, said upper and lower portions being sealed from each other by the seal element.

Thus, the tubular element is effectively turned inside out during the bending process. The bending zone of a respective layer defines the location where the bending process takes place. By inducing the bending zone to move in axial direction along the tubular element it is achieved that the tubular element is progressively expanded without the need for an expander that is pushed, pulled or pumped through the tubular element.

Furthermore, the seal element prevents undesired outflow of fluid from the upper portion of the annular space, or undesired inflow of fluid from the wellbore into said upper portion of the annular space, in case the wall of the tubular element becomes damaged in the bending zone.

Suitably the seal element is provided with a support member for supporting the seal element in the annular space whereby, for example, the support member is supported at the bending zone of the tubular element.

It is preferred that the support member supports the seal element at a selected distance above the bending zone of the tubular element. For example, the support member can be supported from a surface location. Alternatively, the support member comprises gripper means arranged to support the seal element at at least one of the remaining tubular section and the expanded tubular section. In another embodiment the seal element is fixedly connected to one of the remaining tubular section and the expanded tubular section, wherein the seal element is activated by a pressure difference across the seal element.

It is preferred that the wall of the tubular element includes a material that is plastically deformed in the bending zone, so that the expanded tubular section retains an expanded shape as a result of said plastic deformation. In this manner it is achieved that the expanded tubular section remains in expanded form due to plastic deformation, i.e. permanent deformation, of the wall. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

Suitably the bending zone is induced to move in axial direction relative to the remaining tubular section by inducing the remaining tubular section to move in axial direction relative to the expanded tubular section. For example, the expanded tubular section is held stationary while the remaining tubular section is moved in axial direction through the expanded tubular section to induce said bending of the wall.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

If the bending zone is located at a lower end of the tubular element, whereby the remaining tubular section is axially shortened at a lower end thereof due to said movement of the bending zone, it is preferred that the remaining tubular section is axially extended at an upper end thereof in correspondence with said axial shortening at the lower end thereof. The remaining tubular section gradually shortens at its lower end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to the upper end in any suitable manner such as by welding. Alternatively, the remaining tubular section can be provided as a coiled tubing which is unreeled from a reel and subsequently inserted into the wellbore.

Advantageously the wellbore is being drilled with a drill string extending through the unexpanded tubular section. In such application the unexpanded tubular section and the drill string preferably are lowered simultaneously through the wellbore during drilling with the drill string.

Optionally the bending zone can be heated to promote bending of the tubular wall.

BRIEF DESCRIPTION OF THE DRAWINGS

The invention will be described hereinafter in more detail and by way of example, with reference to the accompanying drawings in which.

In the Figures, most of the features are shown in longitudinal section. Furthermore, in the Figures and the description, like reference numerals relate to like components.

DETAILED DESCRIPTION OF THE PREFERRED EMBODIMENTS

Figure 1:
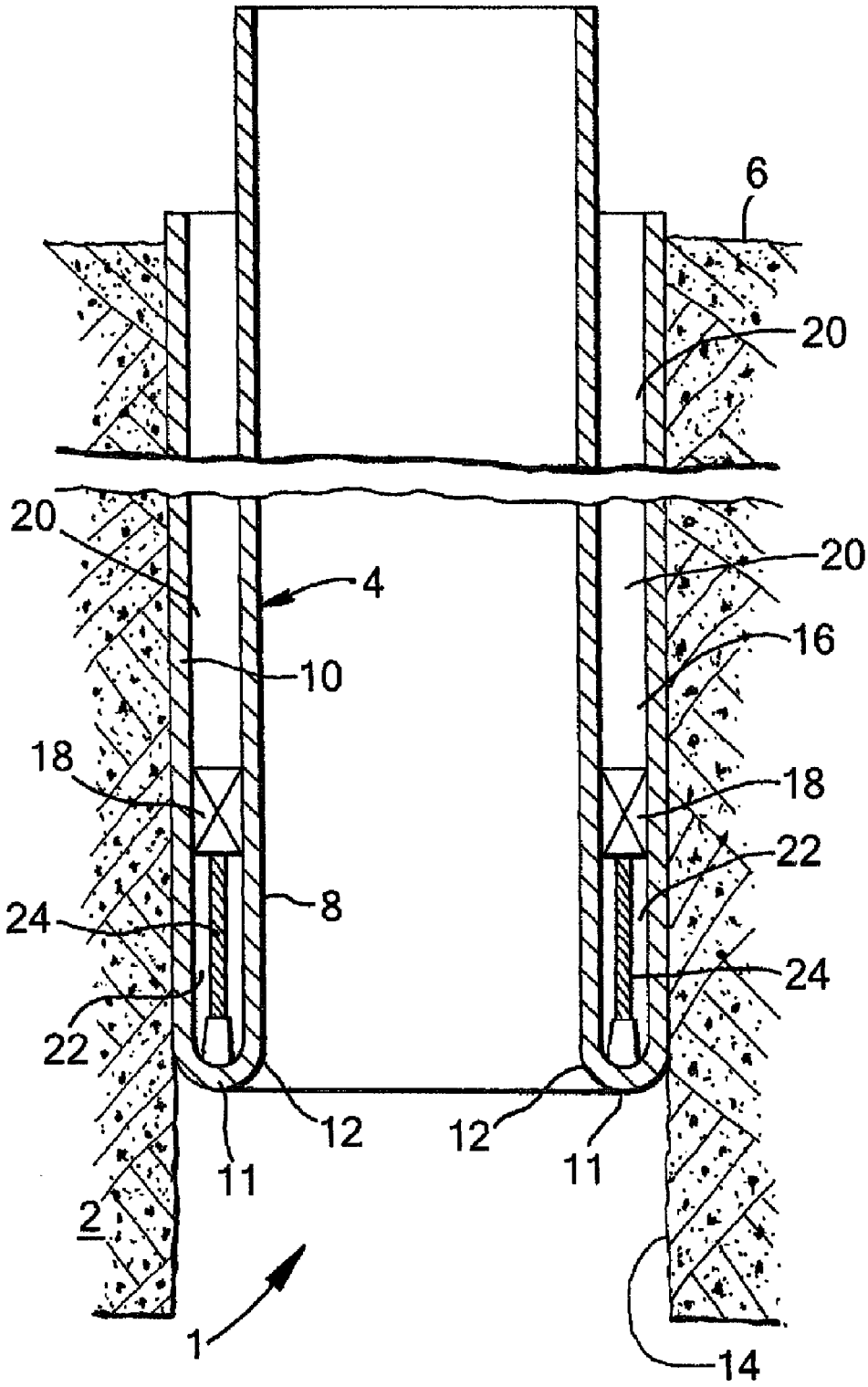
FIG. 1 schematically shows a first embodiment of a wellbore system during eversion of a wellbore liner.

Referring to FIG. 1 there is shown the first embodiment comprising a wellbore 1 extending into an earth formation 2, and a tubular element in the form of liner 4 extending from surface 6 downwardly into the wellbore 1. The liner 4 has been partially radially expanded by eversion of the wall of the liner whereby a radially expanded tubular section 10 of the liner 4 has been formed, which has an outer diameter substantially equal to the wellbore diameter. A remaining tubular section 8 of the liner 4 extends concentrically within the expanded tubular section 10.

The wall of the liner 4 is, due to eversion at its lower end, bent radially outward and in axially reverse (i.e. upward) direction so as to form a U-shaped lower section 11 of the liner interconnecting the remaining liner section 8 and the expanded liner section 10. The U-shaped lower section 11 of the liner 4 defines a bending zone 12 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

The expanded liner section 10 and remaining tubular section 8 define an annular space 16 there between, in which an annular seal element 18 of is arranged so as to define an upper portion 20 and a lower portion 22 of the annular space 16, whereby the seal element 18 seals the upper and lower portions 20, 22 relative to each other. The seal element 18 is supported by an elongate support member in the form of distance holder 24 that, in turn, is supported by the U-shaped lower section 11 of the liner. The distance holder 24 can be formed, for example, as a sleeve or as a series of bars spaced along the circumference of the annular space 16.

Figure 2:
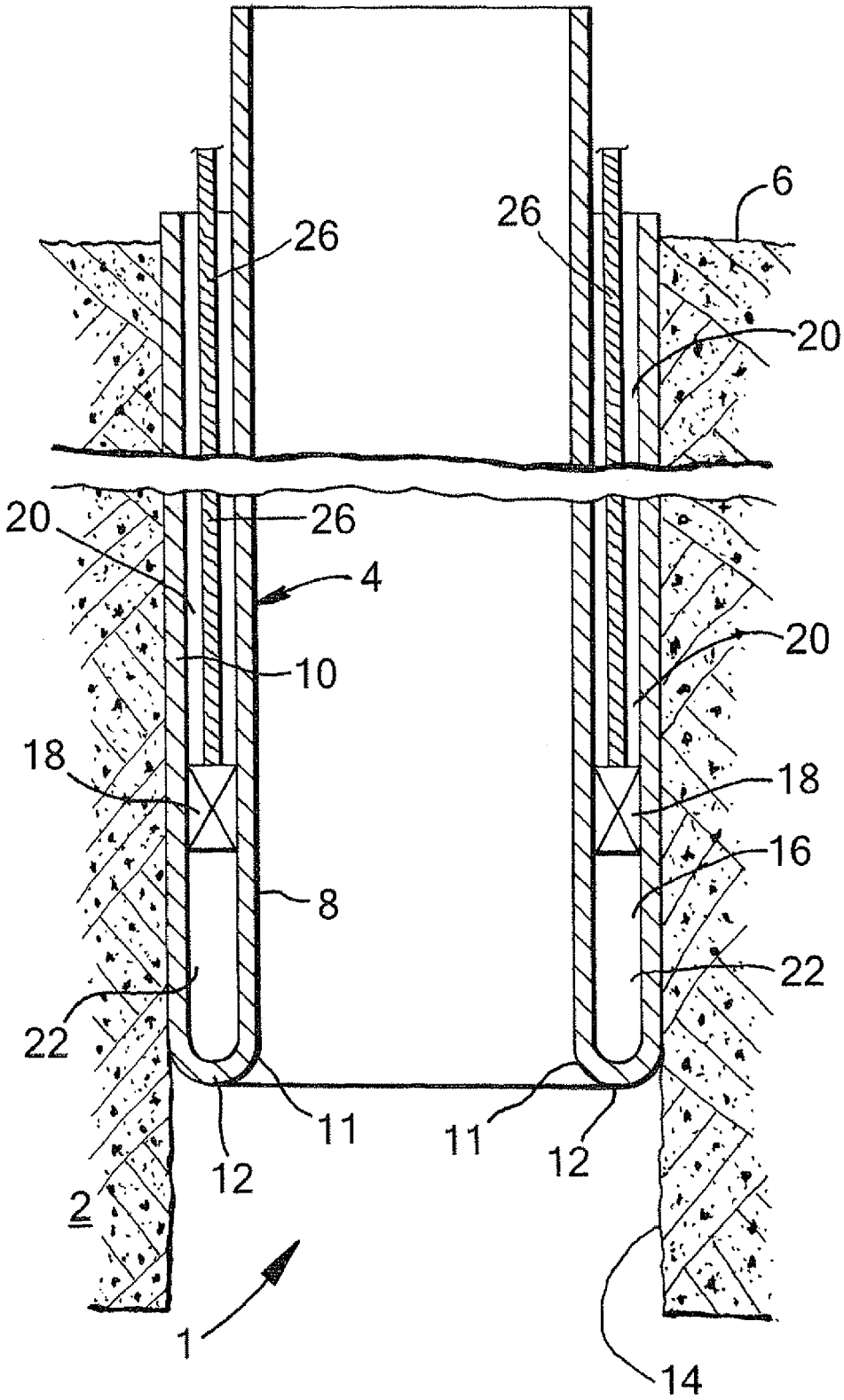
FIG. 2 schematically shows a second embodiment of a wellbore system during eversion of a wellbore liner.

The second embodiment, shown in FIG. 2, differs from the first embodiment in that the seal element 18 is supported by a support member in the form of one or more cables 26 supported from surface, rather than by a distance holder as in the first embodiment.

Figure 3:
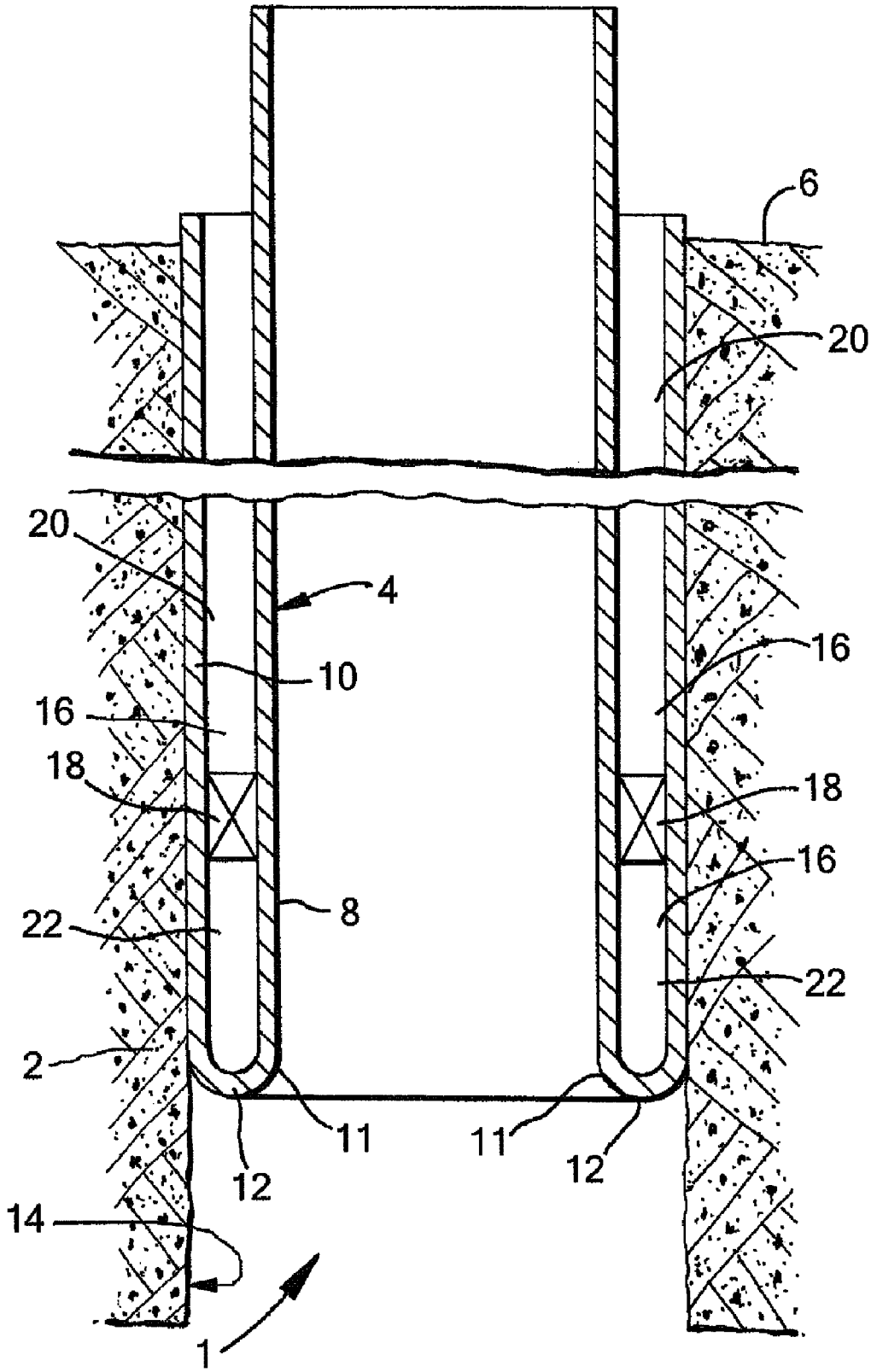
FIG. 3 schematically shows a third embodiment of a wellbore system during eversion of a wellbore liner.
Figure 4:
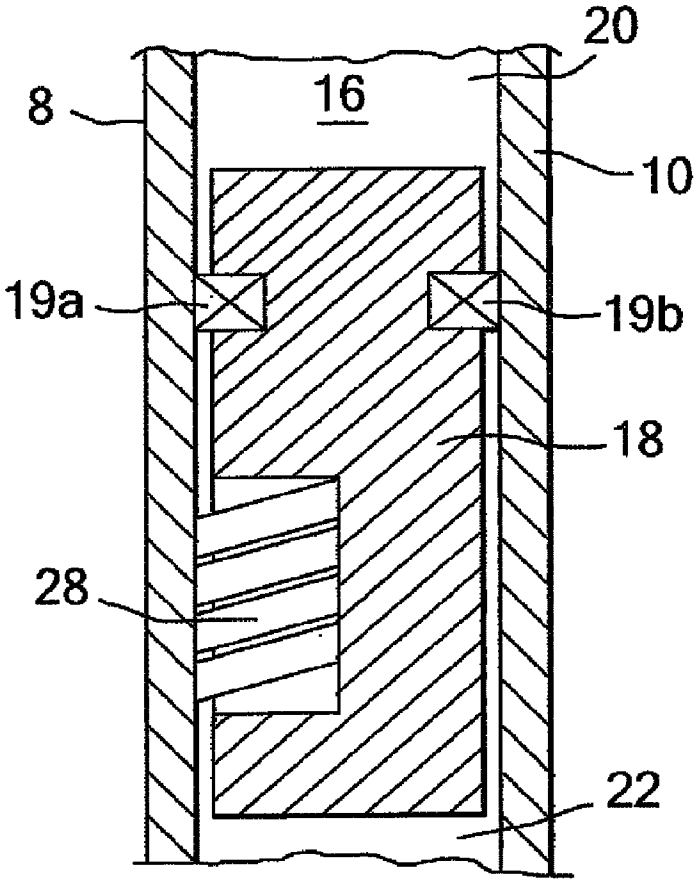
FIG. 4 schematically shows a seal element for use in the third embodiment, in more detail.

In FIGS. 3 and 4 is shown the third embodiment, which differs from the first embodiment in that the seal element 18 is supported by a support member in the form of a gripper device 28 connected to, or integrally formed with, the seal element 18, rather than by a distance holder as in the first embodiment. The gripper device 28 is biased against the remaining liner section 8, and functions to prevent downward movement of the seal element 18 relative to the remaining liner section 8. The seal element 18 is provided with an inner elastomer seals 19*a* for sealing against the remaining liner section 8, and an outer elastomer seals 19*b* for sealing against the expanded liner section 10.

Figure 5:
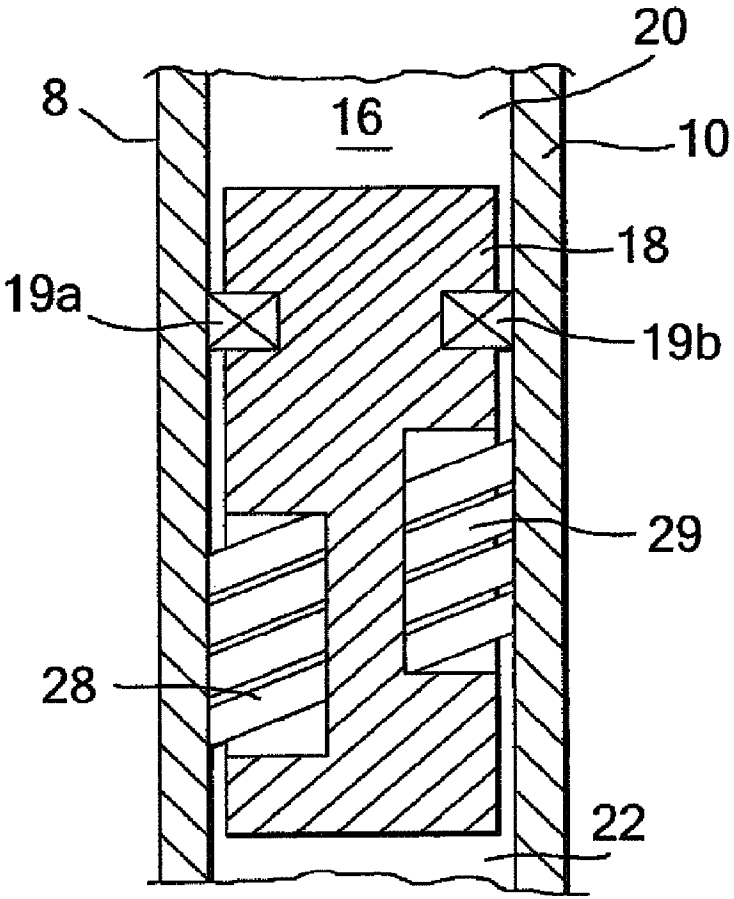
FIG. 5 schematically shows a modified seal element for use in the third embodiment, in more detail.

In FIG. 5 is shown a modified seal element 18' for use in the third embodiment. The modified seal element 18' is substantially similar to the seal element 18, except that the modified seal element 18' is additionally provided with a gripper device 29 connected to, or integrally formed with, the seal element 18. The gripper device 29 is biased against the expanded tubular section 10, and functions to prevent upward movement of the seal element 18' relative to the expanded tubular section 10.

Figure 8:
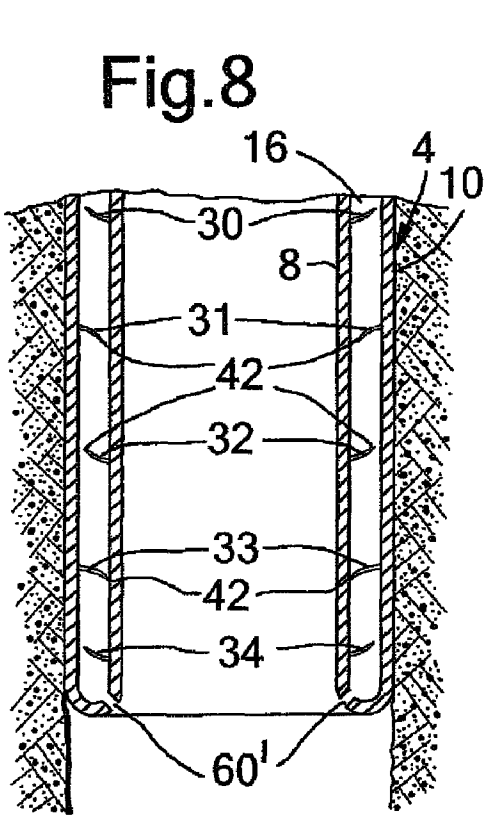
FIG. 8 schematically shows the fourth embodiment when a seal element is activated in a secondary mode of activation.
Figure 7:
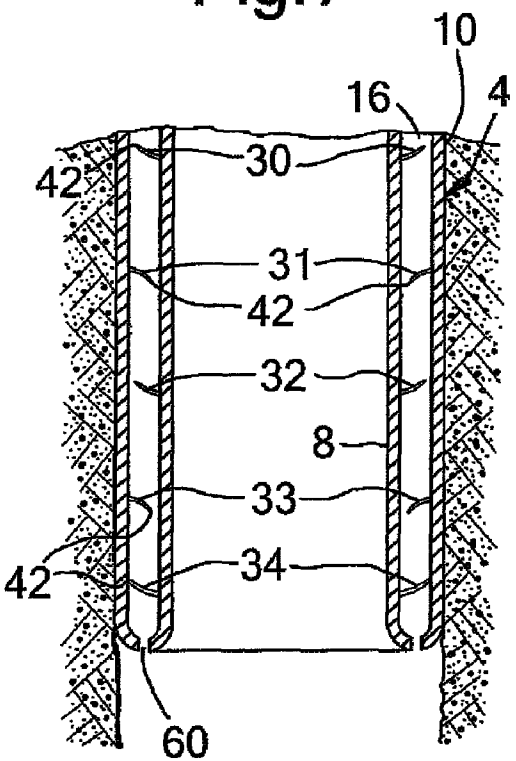
FIG. 7 schematically shows the fourth embodiment when a seal element is activated in a primary mode of activation.
Figure 6:
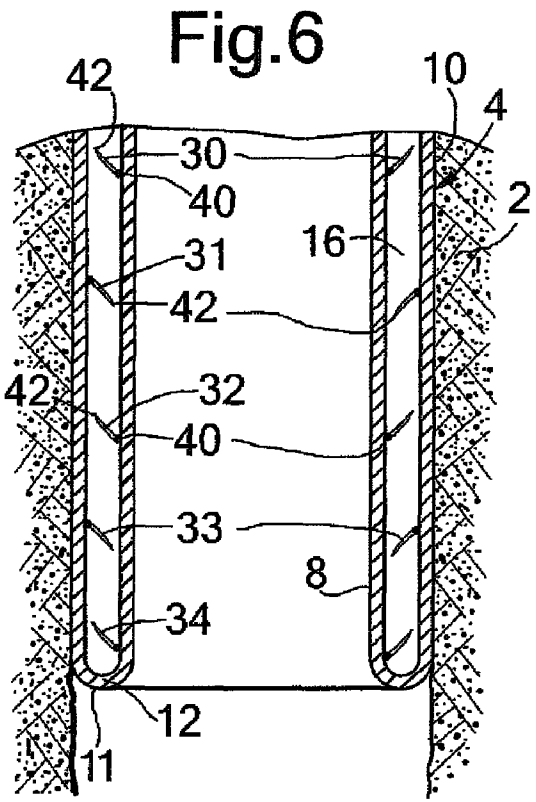
FIG. 6 schematically shows a fourth embodiment of a wellbore system during eversion of a wellbore liner.

In FIGS. 6-8 is shown the fourth embodiment, whereby a series of annular flexible seals 30, 31, 32, 33, 34 are connected to the radially outer surface of the remaining liner section 8 or to the radially inner surface of the expanded liner section 10. It is to be understood that one edge 40 of each flexible seal 30, 31, 32, 33, 34 is connected either to the remaining liner section 8 or to the expanded liner section 10, while the other edge 42 of the flexible seal is free from either liner section 8, 10. The free edge 42 of each flexible seal 30, 32, 34 that is connected to the remaining liner section 8, is adapted to move against the expanded liner section 10 and thereby seal against the expanded liner section 10, upon a fluid pressure in the annular space 16, above the flexible seal 30, 32, 34, exceeding a fluid pressure in the annular space 16, below the flexible seal 30, 32, 34. Also, the free edge 42 of each flexible seal 31, 33 that is connected to the expanded liner section 10, is adapted to move against the remaining liner section 8 and thereby seal against the remaining liner section 8, if a fluid pressure in the annular space 16, below the flexible seal 31, 33, exceeds a fluid pressure in the annular space 16, above the flexible seal 30, 32, 34.

Figure 9:
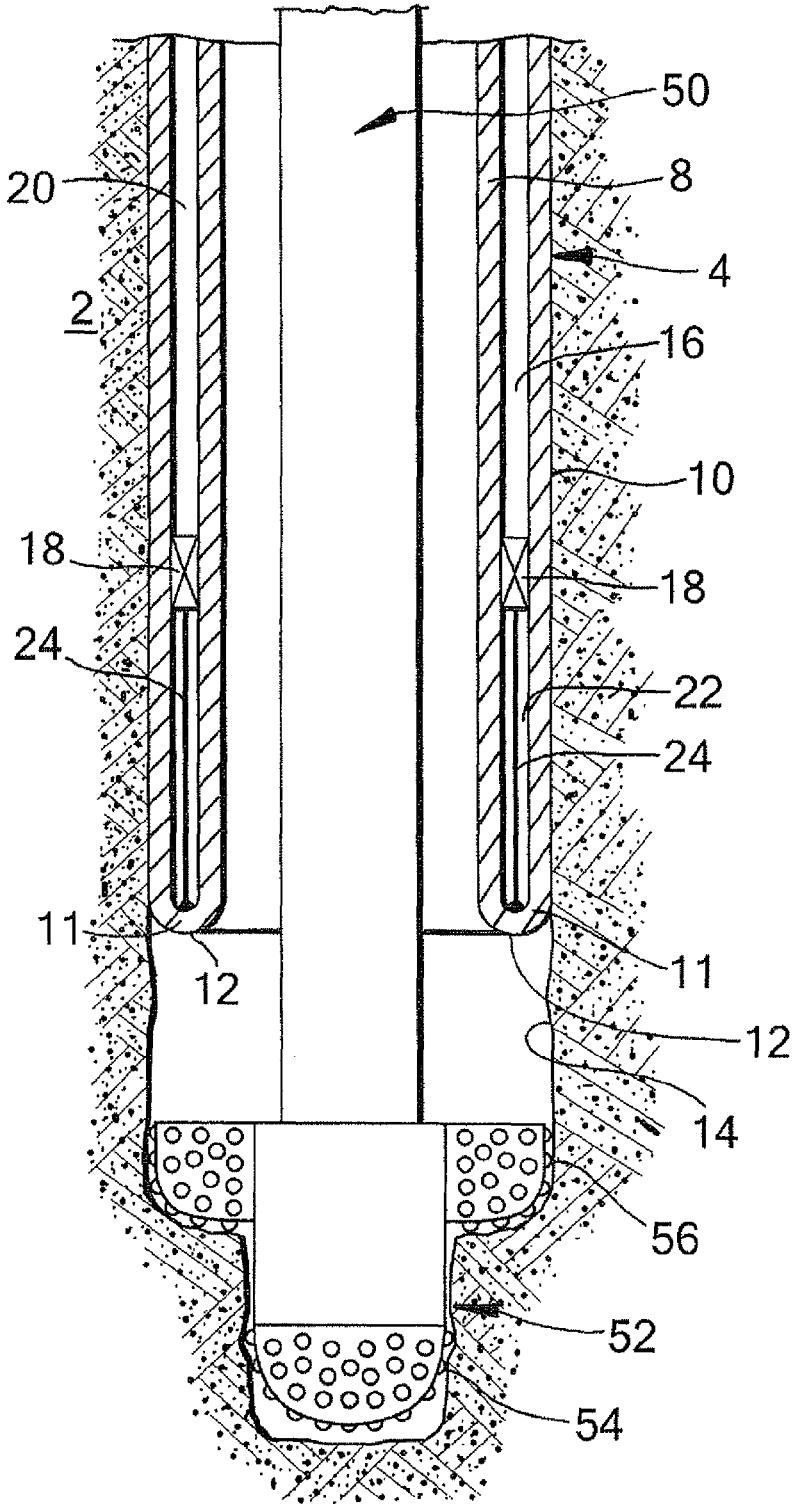
FIG. 9 schematically shows the first embodiment, modified in that a drill string extends through the wellbore liner.

Referring further to FIG. 9, there is shown the first embodiment, modified in that a drill string 50 extends from surface through the unexpanded liner section 8 to the bottom of the wellbore 1. The drill string 50 is at its lower end provided with a drill bit 52. The drill bit 52 comprises a pilot bit 54 with gauge diameter slightly smaller than the internal diameter of the remaining liner section 8, and a reamer section 56 with gauge diameter adapted to drill the wellbore 1 to its nominal diameter. The reamer section 56 is radially retractable to an outer diameter allowing it to pass through unexpanded liner section 8, so that the drill string 50 can be retrieved through the unexpanded liner section 8 to surface.

During normal operation of the first embodiment (FIG. 1), a lower end portion of the liner 4 is initially everted, that is, the lower portion is bent radially outward and in axially reverse direction. The U-shaped lower section 11 and the expanded liner section 10 are thereby initiated. Subsequently, the short length of expanded liner section 10 that has been formed is anchored to the wellbore wall by any suitable anchoring means. Depending on the geometry and/or material properties of the liner 4, the expanded liner section 10 alternatively can become anchored to the wellbore wall automatically due to friction between the expanded liner section 10 and the wellbore wall 14.

A downward force is then applied to the unexpanded liner section 8 so as to move the unexpanded liner section 8 gradually downward. As a result, the unexpanded liner section 8 becomes progressively everted thereby progressively transforming the unexpanded liner section 8 into the expanded liner section 10. The bending zone 12 moves in downward direction during the eversion process, at approximately half the speed of movement of the unexpanded liner section 8.

Before or during the eversion process, the upper portion 20 of the annular space 16 is filled with a body of fluid of relatively high specific weight. That is to say, the fluid in the body of fluid has a specific weight significantly higher than the specific weight of a typical wellbore fluid, such as drilling fluid or brine.

The body of fluid exerts a hydrostatic pressure to the inner surface of the expanded liner section 10, thereby increasing the collapse resistance of the expanded liner section 10. The annular seal element 18 prevents leakage of fluid from the body of fluid into the lower portion 24 of the annular space 16. Therefore, if the wall of the liner 4 in the U-shaped lower section 11 inadvertently is damaged during the eversion process, the seal element 18 prevents leakage of fluid from the body of fluid via such damaged wall portion. It will be understood that the seal element 18 can be positioned fairly close to the U-shaped bending zone 12 since the risk of damage to the wall of the liner 4, once having passed the bending zone 12, is virtually non-existent. The distance holder 24 keeps the seal element 18 at a substantially constant distance from the bending zone 12.

If desired, the diameter and/or wall thickness of the liner 4 can be selected such that the expanded liner section 10 is pressed against the wellbore wall 14 as a result of the expansion process so as to seal against the wellbore wall 14 and/or to stabilize the wellbore wall.

Since the length, and hence the weight, of the unexpanded section 8 gradually increases, the magnitude of the downward force can be gradually lowered in correspondence with the increasing weight of section 8. As the weight increases, the downward force eventually may need to be replaced by an upward force to prevent buckling of the remaining liner section 8.

Normal operation of the second embodiment (FIG. 2) is substantially similar to normal operation of the first embodiment, however differing in that the seal element 18 is supported from surface by means of the cables 26. In order to maintain the seal element 18 at a fixed distance above the bending zone 12, the cables are gradually lowered from surface in correspondence with lowering of the bending zone 12.

Normal operation of the third embodiment (FIGS. 3, 4) is substantially similar to normal of the first embodiment, however differing in that the gripper device 28 keeps the seal element 18 at a substantially constant distance above the bending zone 12. The gripper device 28 prevents downward movement of the seal element 18 relative to the remaining liner section 8, but allows the remaining liner section 8 to slide downward relative to the gripper device 28. If a leak occurs in the wall of U-shaped lower section 11 of liner 4, the eversion process is temporarily stopped, and the gripper device 28 prevents any downward movement of the seal element 18 due to the pressure of the body of fluid exerted to it.

Normal operation of the third embodiment with the modified seal element 18' is substantially similar to normal use of the third embodiment with seal element 18. However, in addition the modified seal element 18' prevents upward movement of the seal element 18' relative to the expanded liner section 10. A tendency for such upward movement could occur, for example, if the wall of the U-shaped lower section 12 becomes damaged during the eversion process, and the wellbore contains high-pressure fluid that flows into the lower portion 22 of annular space 16 at such damaged wall portion.

Normal operation of the fourth embodiment (FIGS. 6-8) is substantially similar to normal operation of the first embodiment, however with the following differences. In the first mode of activation (FIG. 7), the fluid pressure in the annular space 16 at the level of U-shaped lower section 11, exceeds the wellbore pressure at the level of U-shaped lower section 11. Therefore, in case a leak 60 occurs in the wall of the U-shaped lower section 11, fluid flows out from the annular space 16 and into the wellbore 1. The flowing fluid moves the free edge 42 of flexible seal 34 against the expanded liner section 10 and, as a result, the flexible seal 34 seals against the expanded liner section 10. Further outflow of fluid from the annular space 16 is thereby prevented.

In the second mode of activation (FIG. 8), the fluid pressure in the annular space 16 at the level of U-shaped lower section 11, is lower than the wellbore pressure at the level of U-shaped lower section 11. Thus, if a leak 60' occurs in the wall of the U-shaped lower section 11, fluid flows from the wellbore 1 into the annular space 16. The flowing fluid moves the free edge 42 of flexible seal 33 against the remaining liner section 8 and, as a result, flexible seal 33 seals against the remaining liner section 8. Further inflow of fluid from the wellbore 1 into the annular space 16 is thereby prevented.

Normal operation of the modified first embodiment (FIG. 9) is substantially similar to normal operation of the first embodiment regarding eversion of the liner 4 and sealing of seal element 18. In addition, the following features apply to normal operation of the modified first embodiment. The drill string 50 is operated to rotate the drill bit 52 and thereby deepen the wellbore 1 by further drilling. The drill string 40 thereby gradually moves downward into the wellbore 1. Simultaneously, the remaining liner section 8 is moved downward in a controlled manner and at substantially the same speed as the drill string 50, so that it is ensured that the bending zone 12 remains at a short distance above the drill bit 52. Controlled lowering of the remaining liner section 8 can be achieved, for example, by controlling the downward force, or upward force, referred to hereinbefore. Suitably, the remaining liner section 8 is supported by the drill string 50, for example by means of a bearing device (not shown) connected to the drill string, which supports the U-shaped lower section 11. In that case the upward force mentioned hereinbefore, can be applied to the drill string 50, and is transmitted to the remaining liner section 8 via the bearing device. Furthermore, the weight of the unexpanded liner section 8 then can be transferred to the drill string and utilised to provide a thrust force to the drill bit 52.

As drilling proceeds, pipe sections are added at the top of unexpanded liner section 8 in correspondence with its lowering into the wellbore, as is normal practice for installing casings or liners into wellbores.

When it is required to retrieve the drill string 50 to surface, for example when the drill bit 52 is to be replaced or when drilling of the wellbore 1 is complete, the reamer section 56 brought to its radially retracted mode. Subsequently the drill string 50 is retrieved through the unexpanded liner section 8 to surface.

With the method described above, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

After the wellbore 1 has been drilled to the desired depth and the drill string 50 has been removed from the wellbore 1, the length of unexpanded liner section 8 that is still present in the wellbore 1, can be left in the wellbore or it can be cut-off from the expanded liner section 10 and retrieved to surface.

In case the length of unexpanded liner section is left in the wellbore, there are several options for completing the wellbore. These are, for example, as outlined below.

A) A fluid, for example brine, is pumped into the annular space between the unexpanded and expanded liner sections so as to pressurise the annular space and increase the collapse resistance of the expanded liner section. Optionally one or more holes are provided in the U-shaped lower section to allow the pumped fluid to be circulated.

B) A heavy fluid is pumped into the annular space so as to support the expanded liner section and increase its collapse resistance.

C) Cement is pumped into the annular space in order to create, after hardening of the cement, a solid body between the unexpanded liner section and the expanded liner section, whereby the cement may expand upon hardening.

D) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annular space between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described), the expanded liner section can be expanded against the inner surface of another tubular element already present in the wellbore.

The invention claimed is:

1. A method of radially expanding a tubular element extending into a wellbore formed in an earth formation, the method comprising inducing the wall of the tubular element to bend radially outward and in an axially reverse direction so as to form an expanded tubular section extending around a remaining tubular section of the tubular element, wherein said bending occurs in a bending zone of the tubular element; and inducing the bending zone to move in an axial direction relative to the remaining tubular section so as to increase the length of the expanded tubular section;

wherein an annular space is formed between the expanded tubular section and the remaining tubular section, and wherein the method further comprises arranging a seal element in the annular space to define an upper portion and a lower portion of the annular space, said upper and lower portions being sealed from each other by the seal element.

2. The method of claim 1, wherein the seal element is provided with a support member for supporting the seal element in the annular space.

3. The method of claim 2, wherein the support member is supported at the bending zone of the tubular element.

4. The method of claim 3, wherein the support member supports the seal element at a selected distance above the bending zone of the tubular element.

5. The method of claim 2, wherein the support member is supported from a surface location.

6. The method of claim 2, wherein the support member comprises gripper means arranged to support the seal element at at least one of the remaining tubular section and the expanded tubular section.

7. The method of claim 1, wherein the seal element is fixedly connected to one of the remaining tubular section and the expanded tubular section, and wherein the seal element is activated by a pressure difference across the seal element.

8. The method of claim 1 wherein said upper portion of the annular space contains a primary fluid, and the wellbore contains a secondary fluid, and wherein the primary fluid has a higher specific weight than the second fluid.

9. The method of claim 1 wherein the wall of the tubular element includes a material susceptible of plastic deformation in the bending zone during the bending process so that the expanded tubular section retains an expanded shape as a result of said plastic deformation.

10. The method of claim 1 wherein the bending zone is induced to move in an axial direction relative to the remaining tubular section by inducing the remaining tubular section to move in an axial direction relative to the expanded tubular section.

11. The method of claim 10, wherein the remaining tubular section is subjected to an axially compressive force acting to induce said movement of the remaining tubular section.

12. The method of claim 11, wherein said axially compressive force is at least partly due to the weight of the remaining tubular section.

13. The method of claim 1 wherein the remaining tubular section is axially shortened at a lower end thereof due to said movement of the bending zone, and wherein the method further comprises axially extending the remaining tubular section at an upper end thereof in correspondence with said axial shortening at the lower end thereof.

14. The method of claim 1 wherein a drill string extends through the remaining tubular section, the drill string being operated to further drill the wellbore.

15. The method of claim 14, wherein the remaining tubular section and the drill string are simultaneously lowered through the wellbore during drilling with the drill string.

* * * * *